US009630819B2

(12) United States Patent
Ong

(10) Patent No.: US 9,630,819 B2
(45) Date of Patent: Apr. 25, 2017

(54) LOW RIDER WHEEL JACK

(71) Applicant: Andrew H. Ong, Zeeland, MI (US)

(72) Inventor: Andrew H. Ong, Zeeland, MI (US)

( * ) Notice: Subject to any disclaimer, the term of this patent is extended or adjusted under 35 U.S.C. 154(b) by 108 days.

(21) Appl. No.: 14/530,907

(22) Filed: Nov. 3, 2014

(65) Prior Publication Data

US 2015/0137055 A1 May 21, 2015

Related U.S. Application Data

(60) Provisional application No. 61/905,442, filed on Nov. 18, 2013.

(51) Int. Cl.

| | |
|---|---|
| ***B66F 5/02*** | (2006.01) |
| ***B66F 7/12*** | (2006.01) |
| ***B66F 7/06*** | (2006.01) |

(52) U.S. Cl.

CPC ..... *B66F 5/025* (2013.01); *B66F 7/065* (2013.01); *B66F 7/0608* (2013.01); *B66F 7/0625* (2013.01); *B66F 2700/04* (2013.01); *B66F 2700/12* (2013.01)

(58) Field of Classification Search

CPC ..... B66F 7/0625; B66F 7/065; B66F 7/26; B66F 1/00; B66F 2700/04; B66F 2700/12; B66F 3/00; B66F 3/08; B66F 3/12; B66F 5/00–5/04

See application file for complete search history.

(56) References Cited

U.S. PATENT DOCUMENTS 2,829,863 A * 4/1958 Gibson ..... B25H 1/16 108/117
3,286,542 A * 11/1966 Jay ..... B66F 7/0625 74/89.23
3,647,183 A 3/1972 Rishovd
(Continued)

FOREIGN PATENT DOCUMENTS

SU 1312067 A1 5/1987

OTHER PUBLICATIONS

International Search Report and Written Opinion of the International Searching Authority dated Mar. 19, 2015, (International Application No. PCT/US 2014/063709) pp. 1-9.
(Continued)

*Primary Examiner* — Larry E Waggle, Jr.
*Assistant Examiner* — Tyrone V Hall, Jr.
(74) *Attorney, Agent, or Firm* — Price Heneveld LLP

(57) ABSTRACT

A jack apparatus is provided for lifting a low rider vehicle, even though the vehicle has very low ground clearance. The jack apparatus includes interfitting upper and lower subframes supported by a scissor lift. The upper subframe includes opposing parallel arms shaped to fit within a generally triangular cavity defined by the vehicle's tire and sheet metal and ground surface, such that the jack apparatus can engage the vehicle's tire and lift the vehicle without violating the generally triangular cavity, thus leading to a safer and better system for lifting the low rider without potentially damaging vehicle's sheet metal components. The jack apparatus includes width-adjustable arms and legs for flexible use, which are removable or collapsible to a very low shape for compact storage. Also, the upper subframe includes a table, allowing it to lift an ATV or motorcycle.

18 Claims, 12 Drawing Sheets

(56) References Cited

U.S. PATENT DOCUMENTS 4,123,038 A * 10/1978 Meyers ..... B66F 19/00 254/134
4,577,821 A * 3/1986 Edmo ..... B66F 7/08 108/145
4,669,703 A * 6/1987 Hawkins ..... B66C 23/48 254/124
4,753,419 A * 6/1988 Johansson ..... B66F 7/08 254/122
4,854,803 A * 8/1989 Coccaro ..... B60B 29/002 254/111
4,899,985 A * 2/1990 Good ..... B62B 3/0618 254/124
5,131,501 A * 7/1992 Yoshikawa ..... B62B 3/0625 187/244
5,184,930 A 2/1993 Kuhn
5,358,217 A * 10/1994 Dach ..... B66F 3/00 254/134
5,484,134 A 1/1996 Francis
5,503,368 A 4/1996 Torres
5,829,948 A * 11/1998 Becklund ..... B66F 7/0625 187/237
5,855,359 A * 1/1999 Chipperfield ..... B66F 7/0608 254/122
5,911,408 A 6/1999 Berends et al.
5,954,160 A 9/1999 Wells, Sr. et al.
6,045,122 A 4/2000 Torres
6,098,961 A 8/2000 Gionet
D438,684 S * 3/2001 Hernandez ..... D34/33
6,269,676 B1 8/2001 Soyk
6,966,540 B2 11/2005 Falk
8,567,763 B1 * 10/2013 Nolan ..... B66F 3/12 254/122
9,108,463 B2 * 8/2015 Winters ..... B60B 30/02
2008/0101898 A1 * 5/2008 Hernandez ..... B60B 29/002 414/426
2011/0155980 A1 6/2011 Thurm
2011/0253955 A1 * 10/2011 Gann ..... B66F 3/22 254/10 R

OTHER PUBLICATIONS https://www.youtube.com/watch?v=xAh7-nXUPoc &feature=youtu.be; Title: Voltex Hydraulic Tire Jack, Evasive Motorsports; published Dec. 8 2015; :04 second video, 3 pgs.
http://blog.evasivemotorsports.com/?p=1737; Title: Voltex Hydraulic Tire Jack; Evasive Motorsports Company; published Dec. 9, 2015; 1 page.
http://www.evasivemotorsports.com/mm5/merchant.mvc?Screen=PROD&Store_Code=EM&Product_Code=VOL-TJ-1&Category_Code=TIREJACK; Title: Evasive Voltex Hyraulic Tire Jack, publication date unknown; 2 pages.
Photo of prior art jack system, Evasive Motorsports Company, Jul. 2012, 1 page.

* cited by examiner

LOW RIDER WHEEL JACK

CROSS-REFERENCE TO RELATED APPLICATION

This application claims benefit under 35 USC section 119(e) of U.S. Provisional Application Ser. No. 61/905,442, filed Nov. 11, 2013, entitled LOW RIDER WHEEL JACK, the entire contents of which are incorporated herein by reference.

BACKGROUND OF THE INVENTION

The present invention relates to low rider wheel jacks, and more particularly to a jack adapted to engage and lift a vehicle where its body is positioned particularly close to the ground (called a "low rider" herein) such that standard vehicle jacks (called "traditional jacks" herein) cannot be used . . . since there is insufficient room for the traditional jacks to slip under the vehicle before the vehicle is lifted.

"Low riders" are extremely popular vehicles that are characteristically constructed (or modified) to have extremely low ground clearance. It is not uncommon for the body of low riders to have a ground clearance of 1 to 2 inches (or less). In addition to low ground clearance itself, the sheet metal and ground effects of low riders further makes lifting difficult, both due to less clearance but also due to owner's high sensitivity to component damage, deformation, and/or surface abrasion. This creates a problem in that traditional jacks cannot be used since there is insufficient clearance under the vehicle to receive the jack, particularly when the traditional jack lift points on the vehicle's frame are spaced well under the vehicle body's footprint (i.e. the sheet metal's outer edge). Many vehicle service providers refuse to service low rider vehicles due to the difficulty in lifting them, since traditional lifts and jacks often cannot be used, requiring that unusual procedures must be used in order to lift the low rider and do service work.

Many owners of low riders do their own service work, since they love to work on their vehicles, but also since many service providers won't. Many owners of low riders attempt to solve this lifting problem by building ramps that, when driven up, will raise a front (or rear) of the low rider sufficiently so that a traditional jack can be used. Other owners of low riders attempt to solve this "lifting" problem by digging shallow depressions shaped to receive a traditional jack, so that a top of the jack is sufficiently low to allow clearance for a low rider. However, the ramps and pits are often poorly constructed, not well thought out and/or are often "jury rigged," and/or they often require a two-step process where extraordinary care must be used to avoid potential injury or damage to the vehicle. When an appropriate amount of extraordinary care is not used, there is a potentially unsafe condition. The problem is so bad that some low rider owners will remove parts of their vehicle in order to lift their vehicle in order to use a traditional jack. For example, low rider owners have been known to remove front end fascia and sheet metal, ground effect trim, and other vehicle body components to allow jack-lifting their vehicle without damaging a component of the lower rider.

Some jacks have been constructed to have a wheeled frame with a pivoted arm where a free end of the arm can be extended under a stock vehicle, engaged with a lift point on the vehicle frame, and lifted. However, as noted above, many (if not most) low riders have too low of ground clearance to receive the free end of the arm. Further, when the arm is lifted, the axis of rotation is at an outboard pivoted end of the arm (i.e. pivoted at a location opposite the free end), which causes the free end to swing (i.e. move) in an outward arc away from the vehicle. Specifically, as the arm is lifted to higher levels, the free end of the arm moves increasingly outward. This causes a stressed condition where the horizontal movement of the free end pulls against the friction provided by the tires, causing a shear force that will cause the free end to unexpectedly slip on the vehicle's lift point. When this occurs, this "slipping" movement is unexpected, and potentially can cause the vehicle to slip off the jack, thus causing an unsafe condition for the worker and potentially causing damage to the vehicle.

SUMMARY OF THE INVENTION

In one aspect of the present invention, a jack apparatus is provided that is adapted to lift a low rider vehicle having components defining a ground clearance of less than 2 inches vertically and that define with vehicle tires a generally triangular low clearance space. The jack apparatus includes an upper subframe having a pair of horizontally-adjustable lift arms adapted to extend into the low clearance space and engage front and rear surfaces of the tire, a lower subframe having a pair of ground-engaging legs configured to fit into the low clearance space with associated ones of arms and that are located generally under the arms when the arms are raised, and a scissor lift mechanism attached between the upper and lower subframes but not located under the lift arms so that the lift mechanism operates from a position outboard of the vehicle. The arms are movable between a fully-collapsed lowest position where the arms are each laterally adjacent the associated legs, and movable to vertically lifted positions above the lowest position.

In another aspect of the present invention, a jack apparatus, collapsible for compact storage, includes an upper subframe having a pair of lift arms adapted to engage front and rear surfaces of a tire, a lower subframe having an associated pair of ground-engaging legs located generally under the arms when the arms are raised, and a lift mechanism attached between the upper and lower subframes but not located under the lift arms so that the lift mechanism lifts from a position outboard of the tire. The lift mechanism and the upper and lower subframes when in a fully collapsed position define a total height of less than 6 inches for compact storage.

In another aspect of the present invention, a jack apparatus is provided that is adapted to lift a low rider vehicle having components defining a ground clearance of less than 2 inches vertically and that define with vehicle tires a generally triangular low clearance space. The jack apparatus includes an upper subframe having a pair of lift arms adapted to engage front and rear surfaces of a tire, a lower subframe having an associated pair of ground-engaging legs located generally under the arms when the arms are raised, and a lift mechanism attached between the upper and lower subframes but not located under the lift arms so that the lift mechanism lifts from a position outboard of the tire. The arms and legs when in a fully collapsed position define a total height of less than 2 inches and when in a fully collapsed position defining a cross section shaped to fit into the low clearance space.

In another aspect of the present invention, a jack apparatus comprises an upper subframe having a platform supporting a pair of lift arms adapted to engage front and rear surfaces of the tire, a lower subframe having an associated pair of ground-engaging legs located generally under the arms when the arms are raised, and a lift mechanism attached between the upper and lower subframes to lift the upper subframe from a position outboard of the vehicle. The lift mechanism includes a threaded drive screw connected to and moving with the platform for causing the lift mechanism to selectively lift and lower the upper subframe when rotated. The lift mechanism is located entirely outboard of the arms and is attached between the upper and lower subframes and configured to lift the upper subframe.

In another aspect of the present invention, a jack apparatus for lifting either of a tire or a small-vehicle frame, such as a motorcycle frame or ATV frame, comprises an upper subframe having a platform supporting a pair of lift arms adapted to engage front and rear cylindrical surfaces of the tire, a lower subframe having an associated pair of ground-engaging legs located generally under the arms when the arms are raised, and a manually-driven lift mechanism attached between the upper and lower subframes to lift the upper subframe from a side position outboard of the tire. The platform has an exposed upper flat surface configured to engage the small-vehicle frame to selectively lift and lower the small-vehicle frame.

In another aspect of the present invention, a method is provided for lifting a low rider vehicle having components defining a ground clearance of less than 2 inches vertically and that define a generally triangular low clearance space adjacent vehicle tires. The method comprises steps of providing a jack having an upper subframe including a pair of horizontally-adjustable lift arms, a lower subframe including a pair of ground-engaging legs, and a scissor lift mechanism attached between the upper and lower subframes but not located under the lift arms. The method further includes positioning the jack so that the lift arms and legs fit into the low clearance spaces on opposite sides of a vehicle tire with the lift mechanism being located outboard of the vehicle, and operating the scissor lift mechanism to lift the arms and hence the tire and vehicle to at least a height of 4 inches.

In another aspect of the present invention, a jack apparatus comprises an upper subframe having a pair of lift arms adapted to extend into the low clearance space and engage front and rear surfaces of the tire; a lower subframe having a pair of ground-engaging legs configured to fit into the low clearance space with associated ones of arms; and a lift mechanism attached between the upper and lower subframes but not located under the lift arms so that the lift mechanism operates from a position outboard of the vehicle; where the arms are movable between a fully-collapsed lowest position where the arms are each laterally adjacent the associated legs and define a height of less than 2 inches from the ground, and are vertically movable to lifted positions directly above the lowest position.

One aspect of the present invention is to provide a low rider jack that can be used safely and in a non-vehicle-damaging way to lift low rider vehicles, without the user having to jury-rig and/or construct a secondary device to assist with lifting the lower rider vehicle. An object is to provide a jack apparatus that can be used by itself to lift the vehicle to a desired height, or that can be used as a first step in lifting the vehicle (with a more traditional jack being used to lift the vehicle to a final height).

Another aspect of the present invention is to lift a low rider by extending jack arms into a space (i.e. a "generally triangular cavity") defined between a vehicle's tire, vehicle components (e.g. ground-effect components in a fender/wheel-well) and the ground, with the jack being constructed to engage and lift the vehicle's tire while remaining safely away from the vehicle components despite low clearances.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 1:
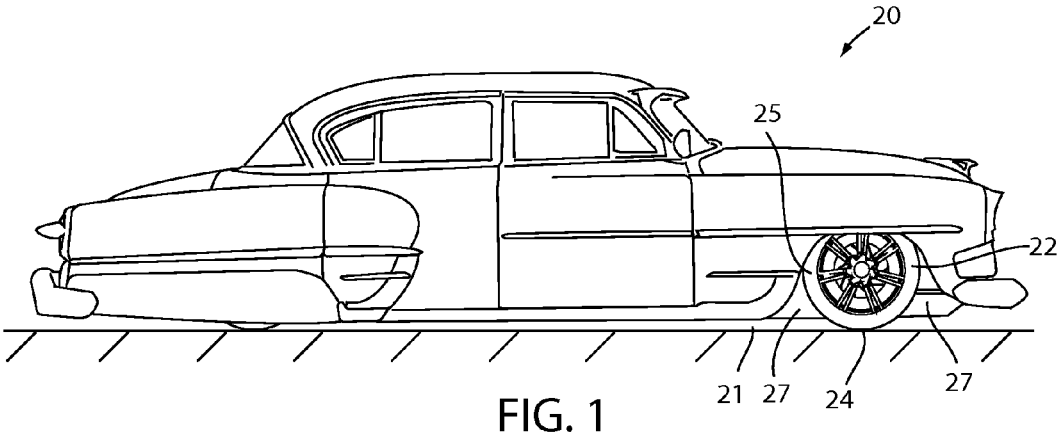
FIG. 1 is a side view of a prior art low rider vehicle.
Figure 2:
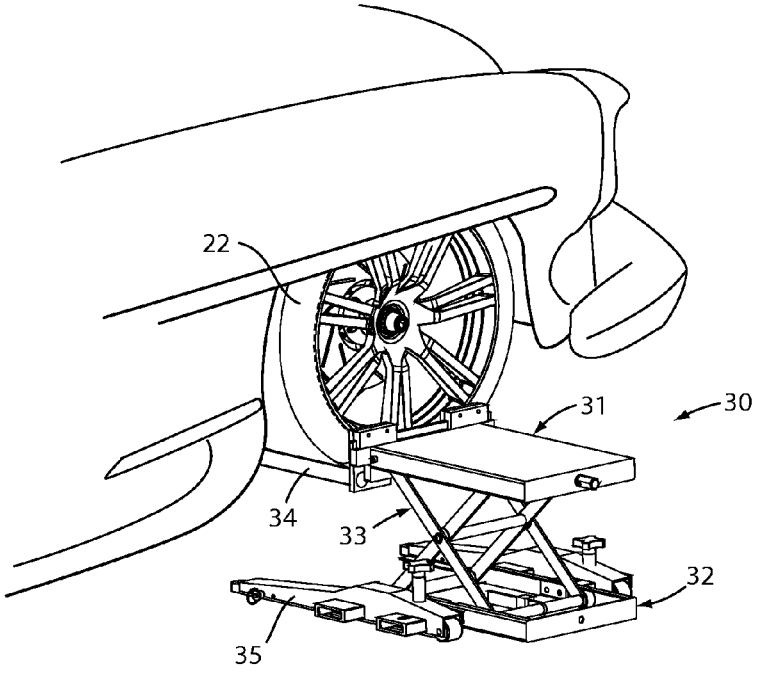
FIGS. 2-2A are perspective and front views of a jack apparatus lifting a tire of the vehicle in FIG. 1.
Figure 2A:
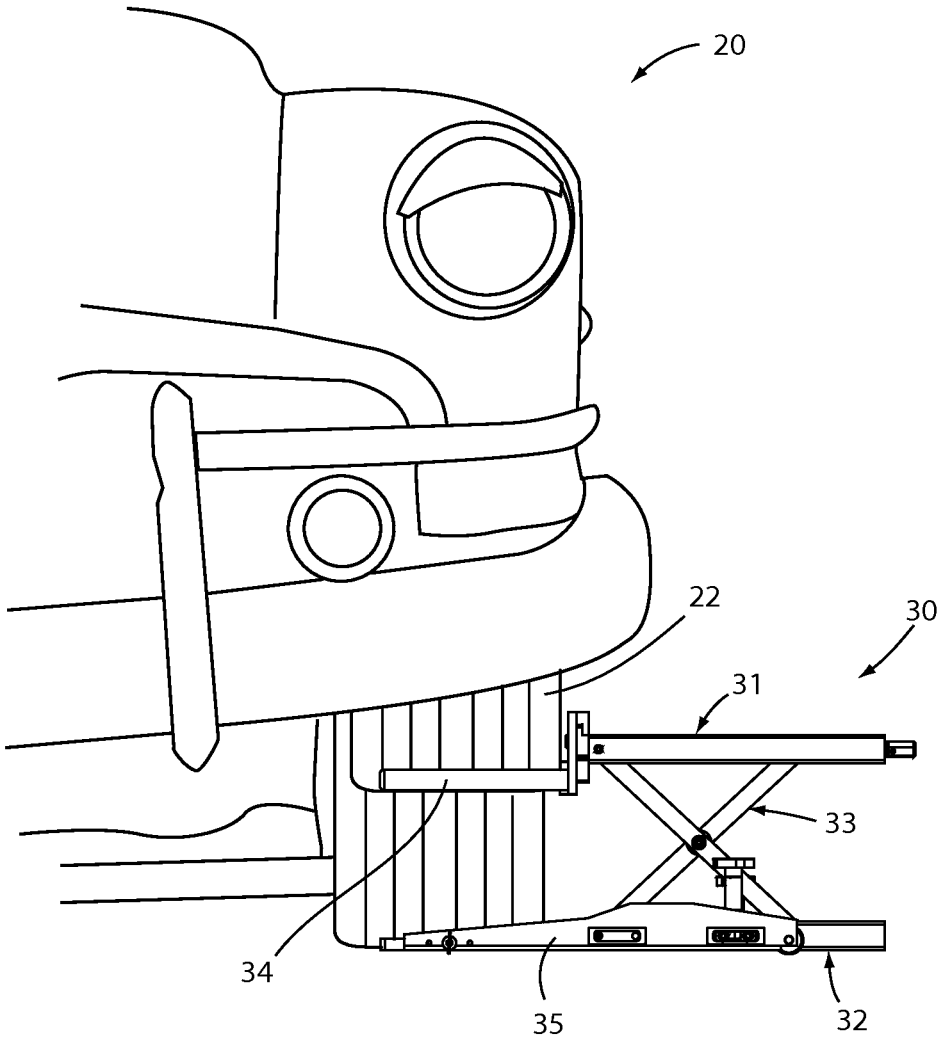
Figure 17:
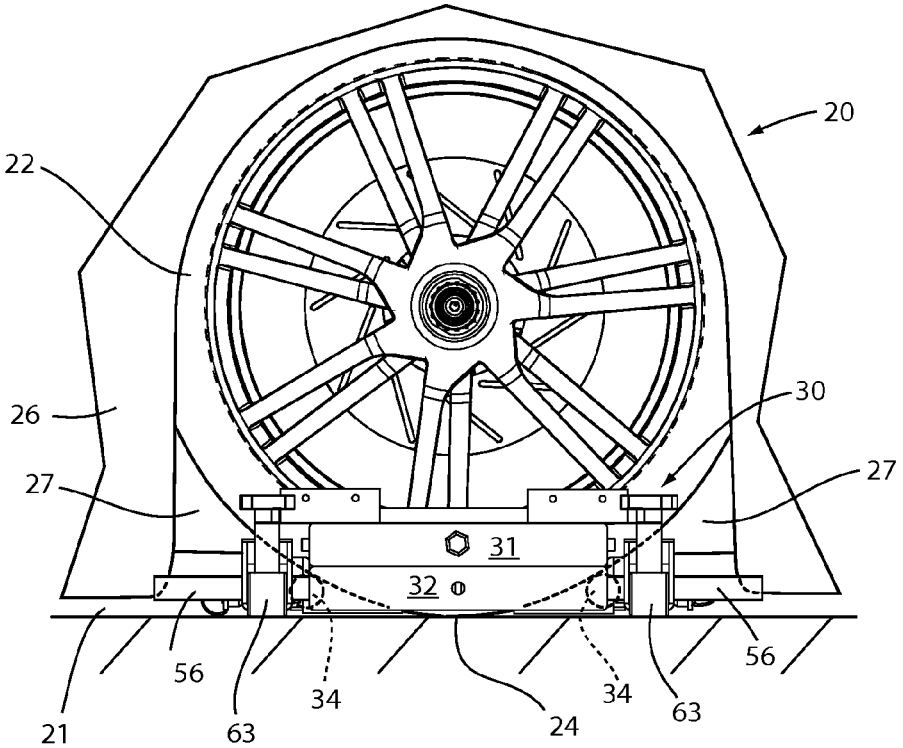
FIG. 17 is a side view showing a low rider tire with components defining a very small clearance area adjacent the vehicle tire.

The present jack apparatus 30 (FIGS. 1-2A) (also called "jack apparatus" or "jack assembly" herein) is provided for lifting low rider vehicles 20 (also called "low riders" herein) (FIGS. 1-2A). Low rider vehicles are vehicles modified to have a unique appearance based in part of their very low ground clearances 21 (e.g. 1-2 inches, or less). Low rider vehicles are well known, and do not require a detailed explanation to persons skilled in this art. Lifting a low rider vehicle for service is a major problem, since the low rider vehicle is so low that its ground clearance prevents extending a traditional jack under the vehicle. Specifically, the illustrated low rider vehicle's tire 22 (FIG. 2) includes a perimeter with a bottom point 24 and an axle-high horizontal point 25 defining with adjacent vehicle components 26 (e.g. fenders, ground effect components, fascia, etc.) the front and rear generally triangular spaces 27 (also called "triangular cavities" herein) at each tire. Notably, the triangular spaces 27 can vary in size and shape, as shown by FIG. 17.

Figure 3:
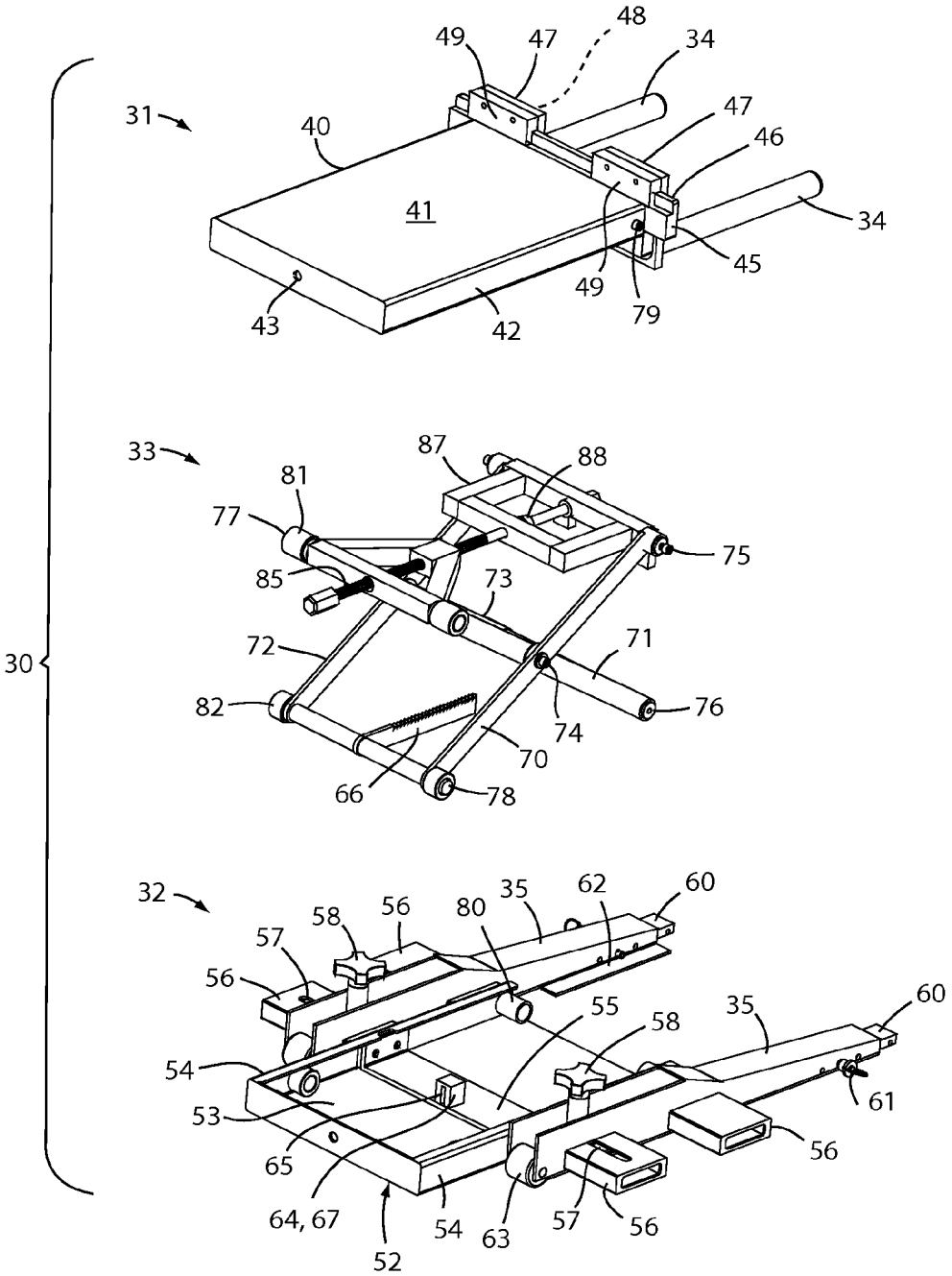
FIG. 3 is a partially exploded top perspective view of the jack apparatus in FIG. 2.
Figure 3A:
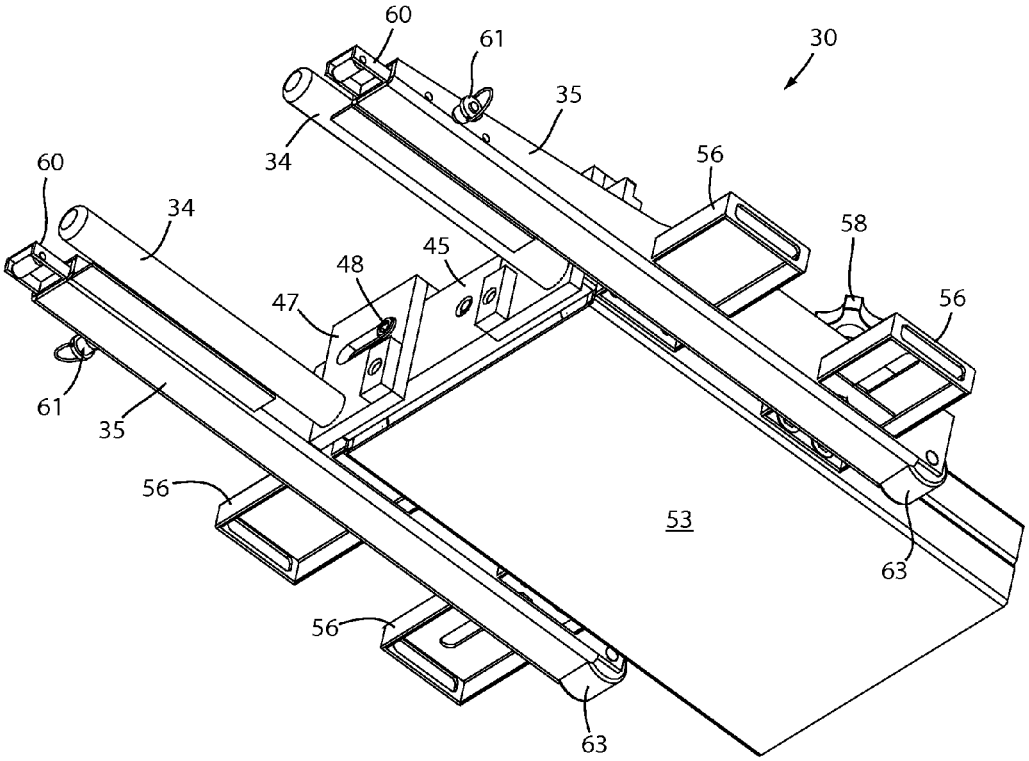
FIG. 3A is a bottom perspective view of same.

The present jack apparatus 30 (FIG. 3) includes interfitting upper and lower subframes 31 and 32, and a scissor lift mechanism 33 for lifting the upper subframe 32. The upper subframe 31 (also called "upper assembly" or "upper frame" or "lift table") has laterally-adjustable parallel arms 34 shaped to nest adjacent the associated leg 35 and fit within the associated triangular cavity 27, with the arms 34 positioned to engage opposing sides of a tire 22. The lower subframe 32 (also called "base assembly" or "base") is laterally adjustable for optimal stability and so that its legs can slide into the triangular space 27 provided by the lower rider. The upper and lower subframes 31 and 32 interfit so that they collapse to an exceptionally small vertical dimension for a jack, such as less than 1-2 inches vertically, and the arms 34 and legs 35 can be adjusted to define a width of only 2-4 inches wide, so that they do not violate (i.e. don't extend outside of) the associated triangular space 27 when engaging the jack assembly 30 with a vehicle tire 22. The scissor lift mechanism 33 (also called "lift mechanism" or "actuator") lifts vertically, thus providing a safe and non-damaging (non-arcuate) motion where jack components remain away from the vehicle components, despite the low clearance conditions. Because of its flexibility and adjustability, the present jack apparatus 30 can be flexibly used on a variety of different low rider vehicles, yet it provides for a much safer and better system for lifting the low rider vehicle 20 because lifting operations are simplified, two-step lifting conditions are eliminated if desired (or at least made much safer), and the risk of damage to components of the low rider vehicle 20 is greatly reduced. Also, it is noted that the upper assembly 32 has a flat table-like surface such that the jack assembly 30 is adapted to support vehicles other than just low rider vehicles, such as ATVs (all-terrain vehicles) and/or motorcycles.

Figure 4:
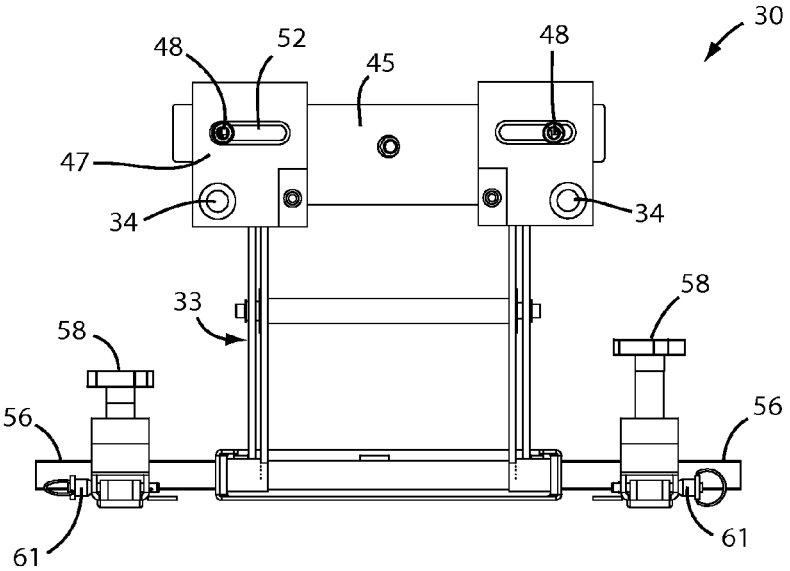
FIGS. 4-7 are inboard, side, outboard and top views of the jack apparatus in FIG. 3, the jack apparatus being near a top of one of its raised positions.
Figure 5:
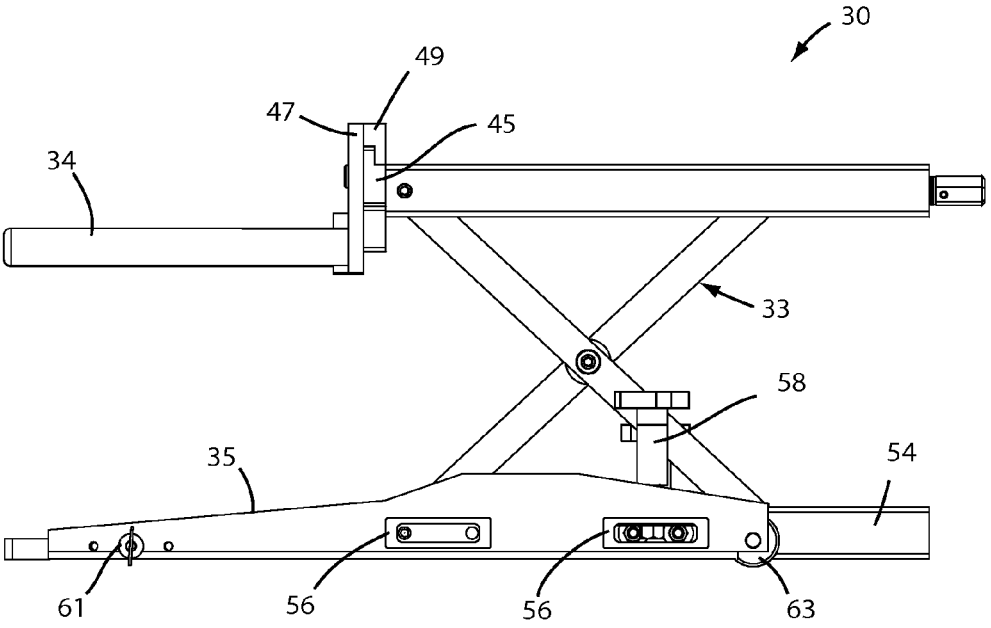
Figure 6:
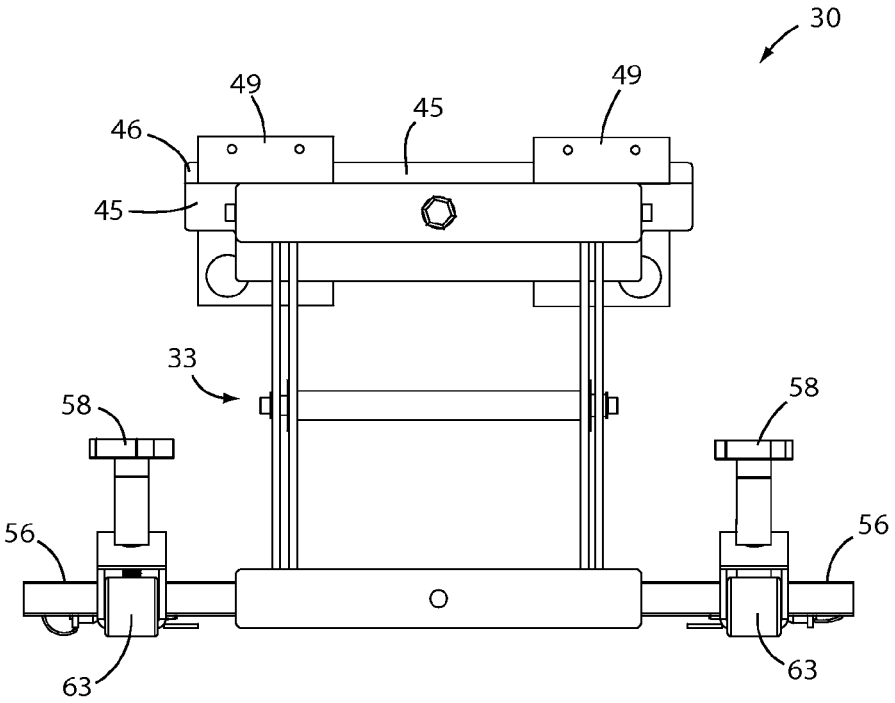
Figure 7:
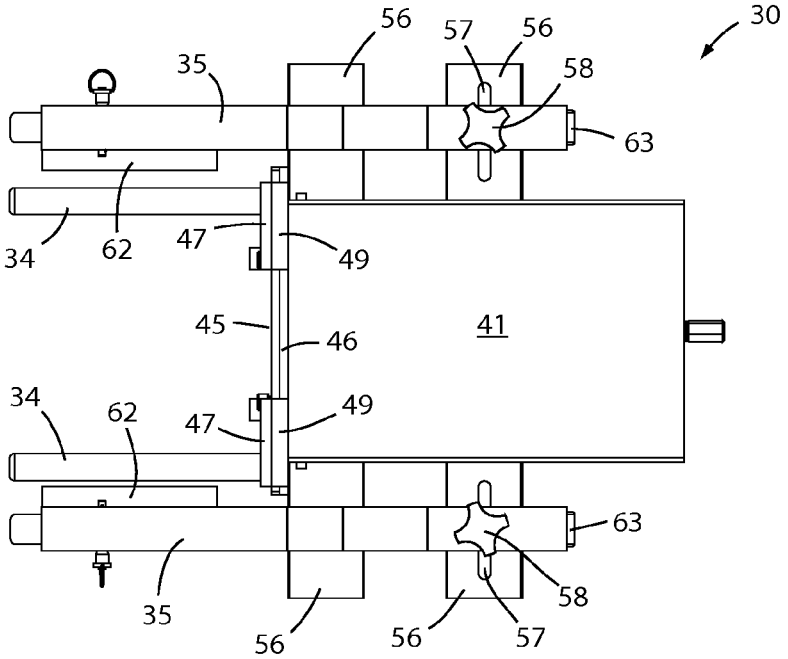

As noted above, the jack apparatus 30 (FIG. 3) includes the upper subframe 31 with arms 34, the lower subframe 32 with legs 35, and the scissor lift mechanism 33. More specifically, the upper subframe 31 includes a top frame 40 with table top flat surface 41 and perimeter stiffening flanges 42, the outboard flange including a hole 43 for receiving the drive screw 85 of the scissor lift mechanism 33 described below. An arm-mounting arm-adjustment structure is attached to the front edge, including a beam 45 with an exposed upper edge forming a guide 46, and arm carriers 47 that slide along the guide 46. Each arm 34 is attached to an arm carrier 46 and extends horizontally from the associated carrier 47. The carriers 46 can be held in an adjusted position by a clamping screw 48 that engages a threaded hole in the beam 45 to clamp a tire-abutting plate 49 against the beam 45. It is noted that the carriers 46 include a horizontal slot (FIG. 4) permitting lateral adjustment on screw 48, and also the beam 45 can include two (or three) horizontally-spaced threaded holes for the clamping screw 48, thus further increasing a length of the lateral (horizontal) adjustment of the arms 34. It is contemplated that ends of the beam 45 can be notched (see notch 45', FIG. 11) to receive cross beams on the lower subframe 32 to permit full collapse even when the arms 34 and legs 35 are positioned adjacently (see FIG. 11). Also, it is noted that the tire-abutting plates 49 (made of polymeric material such as nylon or the like) abut an outboard side of the tire 22, thus securely and safely holding the jack assembly 30 outside of the tire, and away from the vehicle components 26.

The lower subframe 32 (FIG. 3) includes a bottom frame 52 with bottom panel 53 and stiffening side flanges 54. An additional internal cross beam stiffener 55 is added to further strengthen the bottom frame 52. The up-facing side flanges 54 include an additional stiffening plate (or inwardly-facing U-shaped beam member) forming a double-thick wall along all or part of their length, which assists in maintaining a true shape of the track along which the rollers of the scissor-lift mechanism 33 rides, and also which assists in maintaining a rigidity and non-deformed "box" shape of the lower subframe even when lifting heavy loads. An inside of the two opposing side flanges 54 define a track for receiving a roller wheel/bearing of the scissor lift mechanism 33 as described below. A pair of short tubular beam-like mounts 56 extend from an outer side of the side flanges 54, the rearmost of which includes a longitudinal top slot 57. Legs 35 include tubular leg beams shaped to slide laterally on the mounts 56 for lateral width adjustment. A clamp screw 58 with a palm-grip knob handle extends through each beam and through each slot 57 into a nut (not specifically shown) for holding the beam in an adjusted width position. A foot 60 telescopingly engages an open end of the leg beam and a lock pin 61 engages the foot 60 and holes in the leg beam to fix a selected extended position.

It is noted that the internal cross beam stiffener 55 and additional stiffening plate located on the up-facing side flanges 54 are considered important to how the jack sits above the ground, especially when used with the casters or rollers. When rollers are used on front and rear ends of the legs, there is a tendency for a middle of the legs to bow or unacceptably deform when stressed, such as when operating the scissor lift mechanism. Specifically, without the additional internal stiffening plate across the sides of the lower subframe and braces along the up-facing wall of the subframe, a prototype jack tended to unacceptably deform or "fold" more easily under load. Initial testing suggested that it may not be possible to make this jack roll on the ground surface due to the potential for this unacceptable deformation. But due to the internal brace and stiffening of the lower subframe, I was able to keep the jack lower subframe from unacceptable distorsion, thus keeping the scissor-lift working properly even when front/rear rollers prevent continuous ground support along a length of the legs. I consider this important to providing this jack with rolling portability features. This portability makes this a very unique scissor jack that is able to keep its low profile design with use of casters (or rollers).

An inward plate 62 welded to and extending from an inboard bottom side of the leg beam 58 increases the surface contact area with the ground when the jack is used on soft pavement or ground, and also forms a pocket/rest for the arms 34 when in a lowermost position (when the arms 34 are adjusted to be immediately adjacent the legs 35). Casters 63 (or rollers/wheels) are attached to a rear of the leg beams (and optionally are also attached to a protruding front of the foot 60) to assist in rolling the jack apparatus 30 along a ground surface such as when on a cement floor, thus greatly increasing a portability of the jack apparatus 30 and also helping when placing the jack 30 against a vehicle tire 22. A block 64 on the cross beam stiffener 55 includes a slot 65 for receiving a notched ratchet blade 66 on the scissor lift mechanism 33, and includes a releasable ratchet finger 67 that by gravity (or spring bias) engages the up-notches on the ratchet blade 66 to prevent accidental and/or unexpected lowering of the upper subframe 31. The block 64 doubles as a stop to limit collapse of the scissor lift mechanism 33, so that the mechanism is held away from an over-center position where it cannot be easily raised. The plate/beam on an inside of the flanges 54 doubles as a stop to limit upward extension of the scissor-lift mechanism 33 by engaging the lower rollers 82 on the scissor-lift mechanism 33.

The scissor lift mechanism 33 includes right and left X-shaped scissor components 70-71, 72-73 connected by five axles 74-78. The middle axle 74 forms a pivot for the X-shaped scissors components 70-71 and for scissor components 72-73, and also connects the right and left scissors together. The upper front (inboard) axle 75 is attached to the upper subframe 31 slightly rearward of the beam 45 and guide 46, and is stationarily pivoted to the subframe's side flanges at location 79. The lower front (inboard) axle 76 is attached to the lower subframe 32 slightly rearward of its front edge at location 80 (which is directly under the location 79). The upper rear (outboard) axle 77 includes roller bearings 81 that roll along the track defined under the top frame 40 (i.e. inboard of the flanges on the top frame 40). The lower rear (outboard) axle 78 includes rollers/roller bearings 82 that roll along the track defined on the bottom frame 52 inboard of its up flanges 54 on opposing sides. The lower rear axle 78 supports an outboard end of the ratchet blade 66, with the blade 66 extending into the slot 65, with the releasable ratchet finger 67 engaging the notches in the ratchet blade 66. A cross brace (not specifically shown) can also be added between the elongated scissor components 70 and 72, or between 71 and 73, to stabilize the scissors at locations along their length to prevent undesired bending when lifting a load during operation.

The scissor lift mechanism 33 (FIG. 3) includes an Acme drive screw 85 with hex head that extends through the hole 43 for access by a socket wrench or lug nut wrench. The drive screw 85 engages the front flange and beam 45 of the upper subframe 31. Additional box-like U-shaped structure 87 is attached to support the upper front axle 75, with a collar 88 on the drive screw 85 engaging the U-shaped structure 87 to positively keep the drive screw 85 anchored to the scissor lift mechanism 33 and to the upper subframe 31. It is contemplated that indicia (i.e. numbers indicating a measurement) can be placed on the beam 45 or guide 46 so that the tire 22 can be centered on the arms 34 prior to lifting. This helps assure that the tire 22 will be centered on the arms in a position where the likelihood of damage to the low rider is minimized. The illustrated jack 30 can lift the top subframe 31 about 18 inches.

Figure 8:
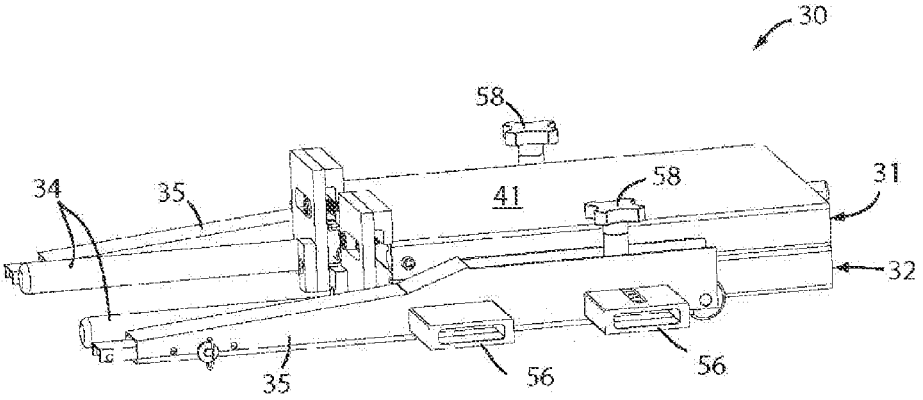
FIGS. 8-10 are perspective, side and inboard views of the jack apparatus in FIG. 4.
Figure 9:
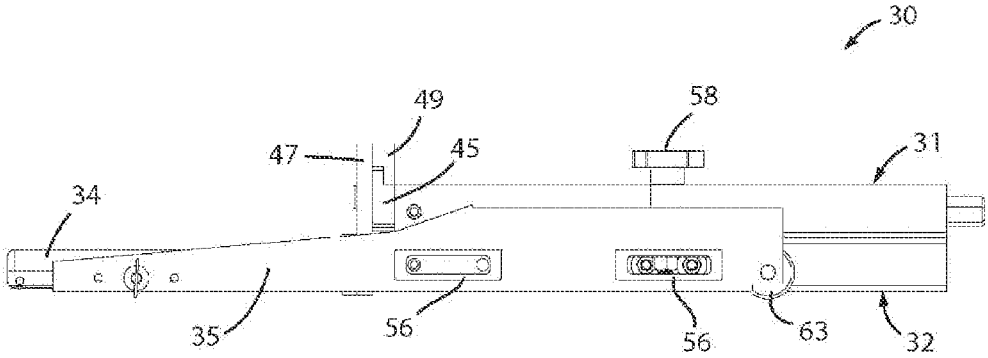
Figure 10:
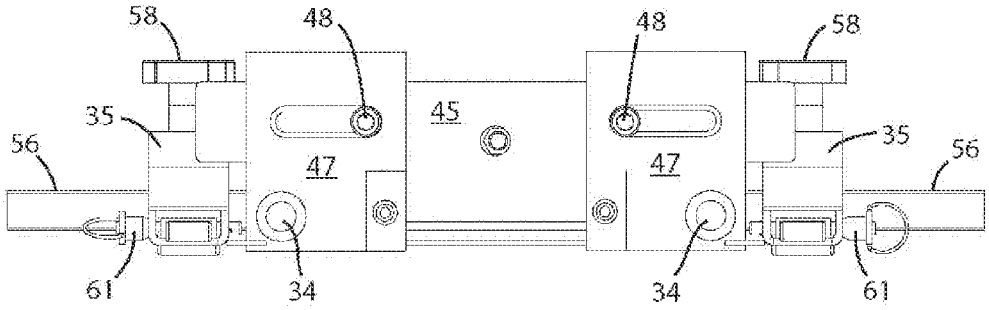

FIGS. 8-10 illustrate the very low vertical height of the present jack apparatus 30 when fully collapsed. The height may vary, but when fully collapsed, a prototype jack apparatus 30 will preferably be below about 6 inches total height (or more preferably less than about 5 inches total height) at the scissor lift portion of the jack, and is below about 3 inches (or more preferably less than about 2 inches or most preferably below 1 inch) on the lift arms of the jack. This compact arrangement also facilitates storage in a small space. Notably, the arms 34 and legs 35 can be removed. Thus further reducing a size of the jack apparatus 30 when stored. Still further, the very low weight of the present jack apparatus 30 contributes to its portability and storability. Specifically, a total weight of the jack apparatus is preferably less than 100 pounds, or more preferably less than 70 pounds depending on functional requirements. I have constructed a prototype jack apparatus 30 of aluminum that is about 50 pounds and that still was structurally sound, durable, robust, and sufficient to safely lift most low rider vehicles.

Dimensions of the jack apparatus 30 can vary as needed for particular applications. One prototype jack apparatus 30 had an overall vertical dimension of 5 inches when fully collapsed and 17 inches when fully raised. A height of the tire-engaging lift arms from ground to top surface was 1 inch when fully collapsed, and 14 inches when fully raised. Total dimensions of arm-to-adjacent-leg were 1.5 inches when adjusted to adjacent positions, and the arms were adjustable to 17 inches max outward adjustment and legs were adjustable to 22 inches max outward adjustment.

Figure 11:
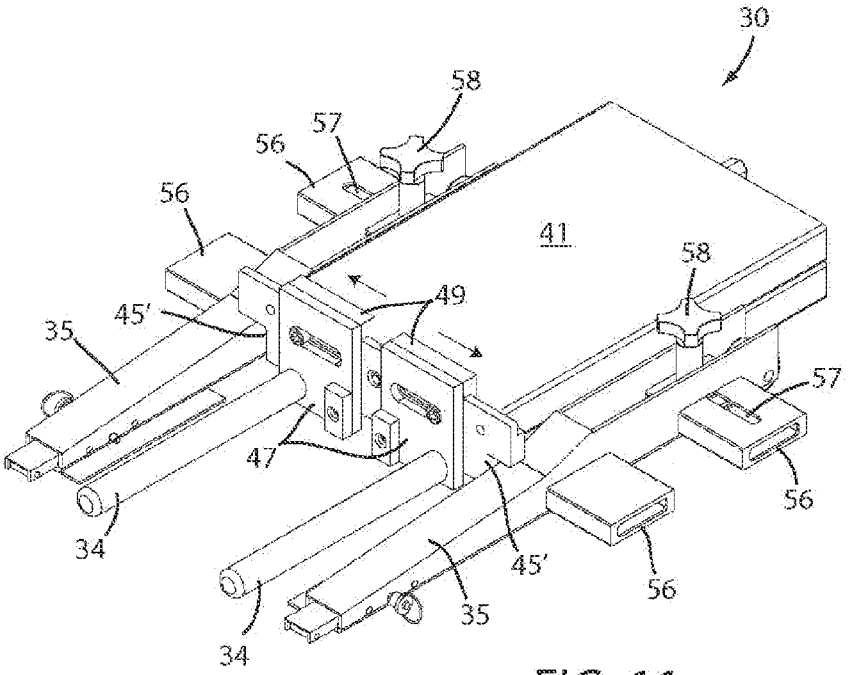
FIGS. 11-12 are perspective views showing laterally-adjusted positions of the jack's arms.
Figure 12:
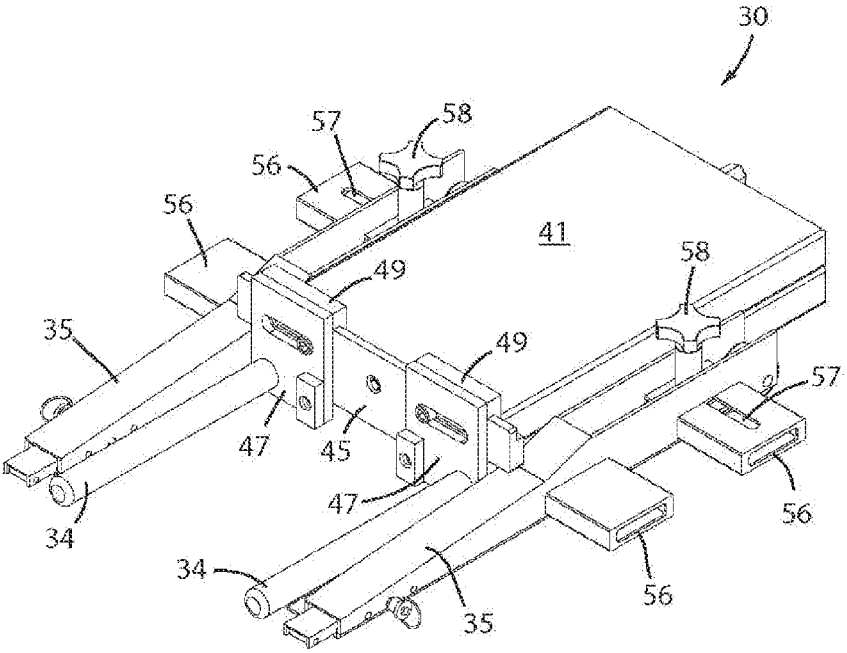
Figure 13:
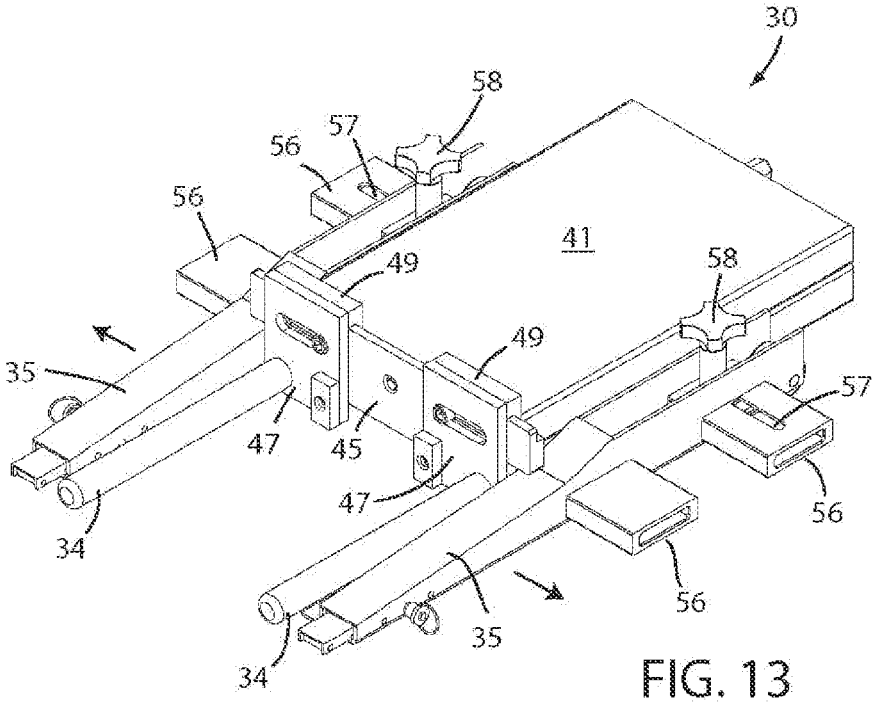
FIGS. 13-14 are perspective views showing laterally-adjusted positions of the jack's legs.
Figure 14:
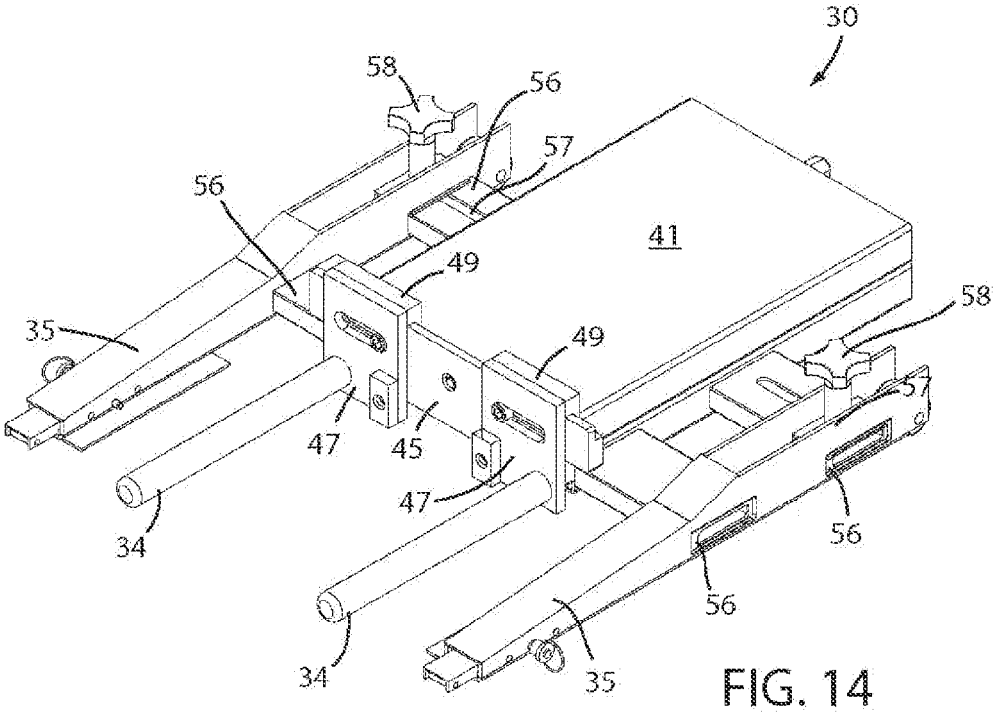
Figure 15:
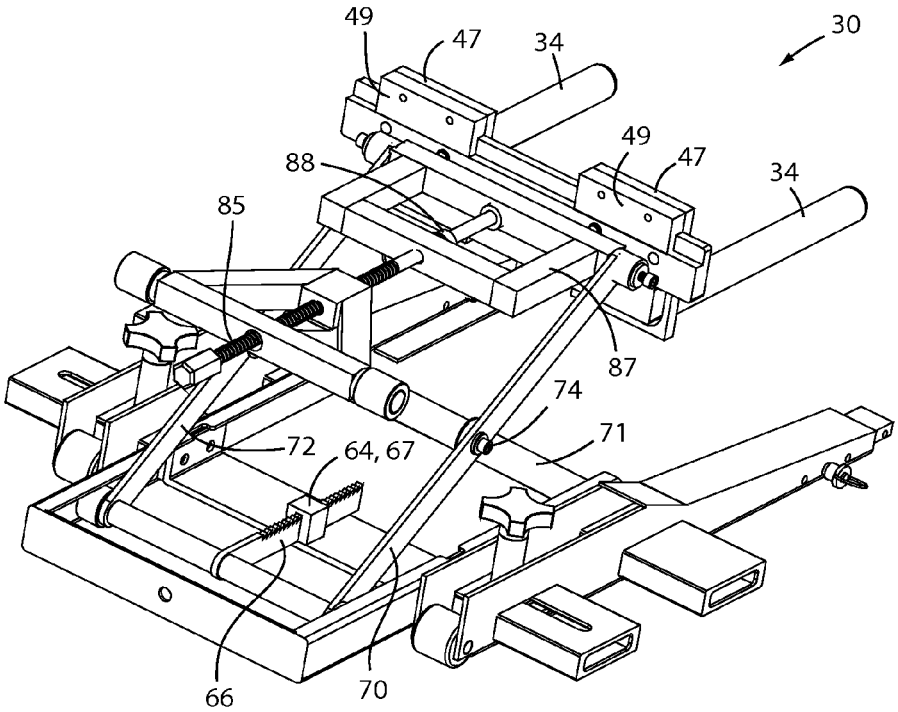
FIGS. 15-16 are perspective views showing raised and lowered positions of the scissor lift, with the upper subframe being eliminated to show underlying components.
Figure 16:
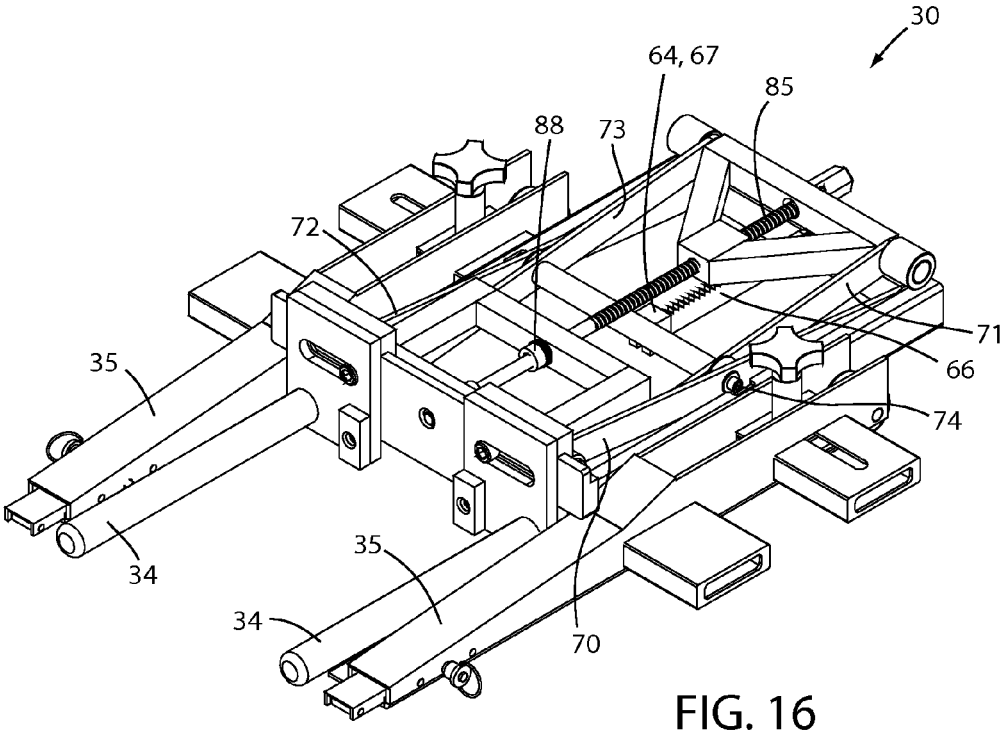

FIGS. 11-12 illustrate lateral (width) adjustment of the arms 34 and their relation to the legs 35. FIGS. 13-14 illustrate lateral (width) adjustment of the legs 35 and their relation to the arms 34. FIGS. 15-16 illustrate vertical operation of the jack apparatus 30, and show a relationship of various components as the scissor lift mechanism 33 is operated.

FIG. 17 illustrates that the arms 34 and legs 35 of the present jack apparatus 30 can be adjusted so that the jack can be used on low rider vehicles, even when there are very small clearances around the tires.

Figure 18:
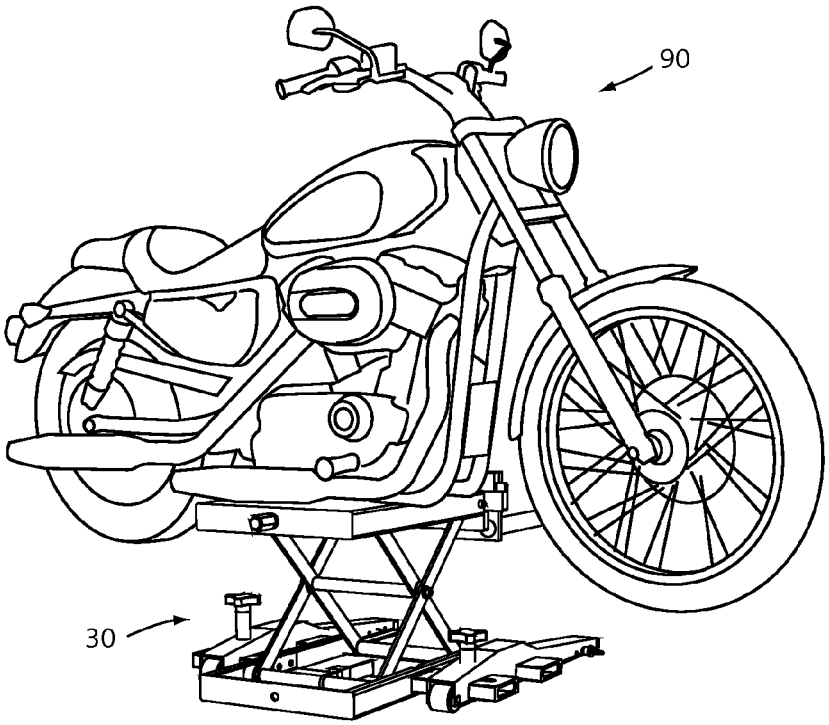
FIG. 18 is a perspective view showing a motorcycle lifted by the jack apparatus of FIG. 2.

FIG. 18 illustrates that the flat top surface on the upper subframe 31 creates a table-like surface that can be used to lift many different vehicles, such as a motorcycle 90 or an ATV vehicle (not illustrated). Specifically the subframe 31 is shaped to engage the exposed lower frame portion of a motorcycle that is generally under the motorcycle engine where a majority of the motorcycle's weight is (and also where a center of gravity is located).

It is contemplated that the present apparatus 30 can incorporate substitute components and still be within a scope of the innovation herein. For example, different lift mechanisms can be used other than the illustrated scissor lift mechanism, and different than the Acme screw drive system (such as a pneumatic system using compressed air, or a hand pump system, or a hydraulic system).

It is noted that the present apparatus 30 lifts a tire 22 very close to a true vertical direction, which is advantageous since it avoids most "side stresses". Contrastingly, many traditional jacks have a pivoted arm which causes potential problems from side stresses due to an outward arcuate movement of the free end of the pivoted arm when the jack is used to lift the vehicle.

Figure 19:
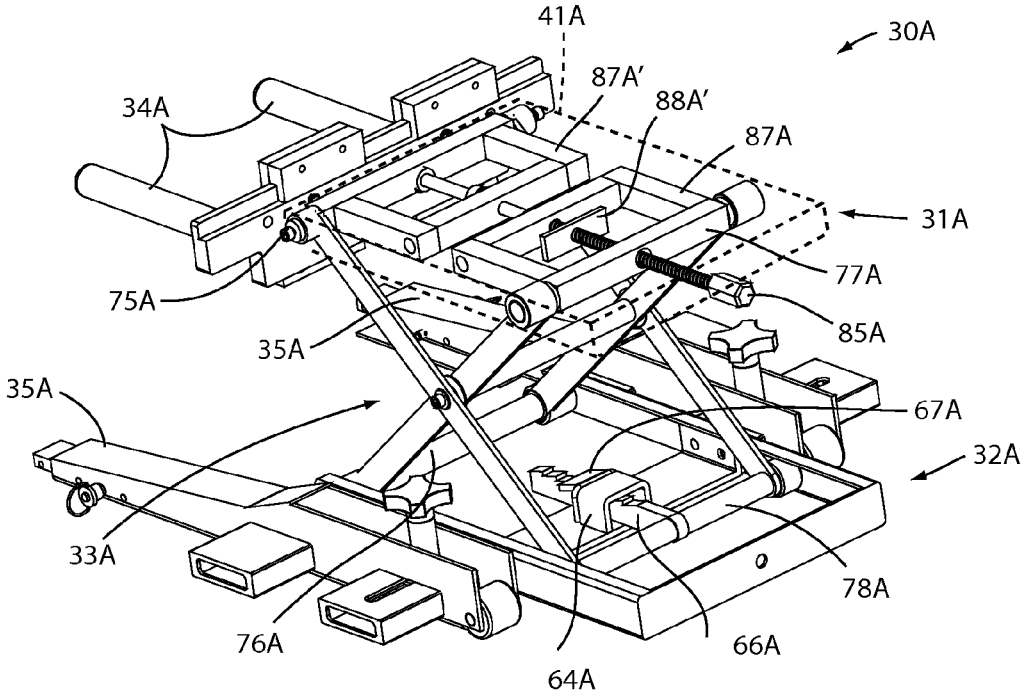
FIGS. 19-20 are front and rear perspective views showing a modified jack apparatus similar to the jack apparatus in FIGS. 2-7, but including additional stiffening structure under an outboard side of the upper subframe and supporting the drive screw.
Figure 20:
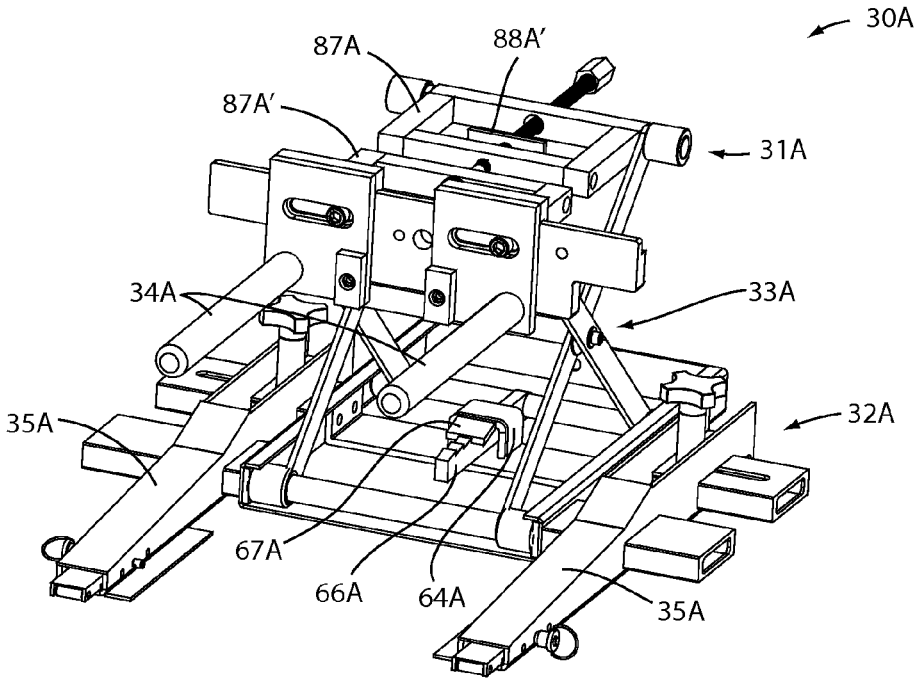

FIG. 19 is a perspective view showing a modified jack apparatus similar to FIGS. 2-7 but including additional U-shaped stiffening structure 87A' on the lift mechanism under an outboard side of the upper subframe 31A. In FIG. 19, identical and similar components are identified using the same identification numbers but with a letter "A". This is done to reduce redundant discussion. Also, the table top flat surface 41A is eliminated (i.e. shown in dashed lines) to show underlying components, including the U-shaped stiffening structure 87A'. Specifically, a U-shaped structure 87A' is attached to support the upper front (inboard) axle 75A, opposite the U-shaped structure 87A. An anti-slip nut 88A' on the drive screw 85A threads onto the drive screw 85A so that it engages the U-shaped structure 87A' to positively prevent unexpected collapse even if some of the threads of the drive screw 85A become stripped. It also prevents unexpected collapse if the threads on the U-shaped structure 87A located on a free end of the scissor arm next to the axle 77A become stripped. FIG. 19 shows the drive screw 85A having a threaded male end at its outer end, and located next to axle 77A is the female receiving end of threads. FIG. 19 also shows additional details of the block 64A, ratchet blade 66A, and ratchet finger 67A, the ratchet finger 67A being pivoted to the block 64A and downwardly biased by gravity. It is contemplated that the ratchet finger 67A may also be biased by a spring such as a leaf spring or torsional spring (not specifically shown). The other components were previously described for an understanding by persons skilled in this art, such as components, 30A, 32A, 33A, 34A, 35A, 76A, 77A, and 78A.

It is to be understood that variations and modifications can be made aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A jack apparatus adapted to lift a low rider vehicle having components defining a ground clearance of less than 2 inches vertically and that define with vehicle tires a generally triangular low clearance space, comprising:

an upper subframe having a pair of horizontally-adjustable lift arms adapted to extend into the low clearance space and engage front and rear surfaces of the tire;

a lower subframe having a pair of ground-engaging legs configured to fit into the low clearance space with the lift arms and that are located generally under the lift arms when the lift arms are raised; the lower subframe including at least one horizontal beam mount comprising a slot, the horizontal beam mount extending substantially perpendicular on at least one side of the lower subframe and wherein the pair of ground-engaging legs include a slot engaging fastener for engaging the slot of the horizontal beam mount for laterally adjusting the ground engaging legs on the horizontal beam mount; and a scissor lift mechanism attached between the upper and lower subframes but not located under the lift arms so that the lift mechanism operates from a position outboard of the vehicle; the scissor lift mechanism including a first upper axle rotatably secured to the upper subframe on a vehicle-adjacent lift-arm-adjacent side of the upper subframe and including a first lower axle rotatably secured to the lower subframe on a vehicle-adjacent lift-arm-adjacent side of the lower subframe;

the lift arms being movable between a fully-collapsed lowest position where the arms are each laterally adjacent the associated legs, and movable to vertically lifted positions above the lowest position; and the scissor lift mechanism including a threaded screw attached horizontally to the upper subframe and that moves with and remains constantly horizontally adjacent the upper subframe when operating the lift mechanism between lower-most and raised positions.

2. The jack apparatus of claim 1, including a horizontal beam on the upper subframe, and wherein the arms are laterally adjustable on the horizontal beam.

3. The jack apparatus of claim 2, wherein the horizontal beam includes slots and slot-engaging fasteners for fixing the arms in a selected laterally adjusted position where the arms clear the legs when the upper subframe is in the fully-collapsed lowest position.

4. The jack apparatus of claim 1, wherein the legs each include a telescopingly extendable foot.

5. The jack apparatus of claim 1, wherein at least one or both of the legs and arms includes a telescopingly extendable member.

6. The jack apparatus of claim 1, wherein the upper subframe includes a table top flat surface that is upwardly exposed for supporting one of an ATV vehicle or motorcycle thereon.

7. The jack apparatus of claim 1, wherein the upper and lower subframes define a maximum total height dimension of less than 6 inches when in the fully-collapsed lowest position.

8. The jack apparatus of claim 1, wherein the arms are slidingly removable in an outboard direction.

9. The jack apparatus of claim 1, wherein the lower subframe includes ground-engaging casters for rolling portability.

10. The jack apparatus of claim 1, wherein the upper and lower subframes and lift mechanism define a total weight of less than about 70 pounds.

11. The jack apparatus of claim 1, wherein the lower subframe includes a frame structure forming up-facing side flanges and further includes a cross stiffener extending between the side flanges near a middle region of the side flanges, the side flanges being made of a light weight material but the cross stiffener maintaining a stiffness near a center of the frame structure that prevents undesired deformation.

12. A jack apparatus adapted to lift a low rider vehicle having components defining a ground clearance of less than 2 inches vertically and that define with vehicle tires a generally triangular low clearance space, comprising:

an upper subframe including a table top flat surface and perimeter stiffening flanges providing rigidity, and having a pair of horizontally-adjustable lift arms extending from a vehicle-adjacent side of the upper subframe and that are adapted to extend into the low clearance space and engage front and rear surfaces of the tire;

a lower subframe having a pair of ground-engaging legs configured to fit into the low clearance space with the lift arms and that are located generally under the lift arms when the lift arms are raised; the lower subframe including at least one horizontal beam mount comprising a slot, the horizontal beam mount extending substantially perpendicular on at least one side of the lower subframe and wherein the pair of ground-engaging legs include a slot engaging fastener for laterally adjusting the ground engaging legs on the horizontal beam mount; and a scissor lift mechanism including right and left scissor components including multiple axles extending between and interconnecting the right and left scissor components, with at least one of the axles rotatably engaging the upper subframe, the scissor lift mechanism being attached between the upper and lower subframes but not located under the lift arms so that the lift mechanism operates from a position outboard of but adjacent the vehicle; and the arms being movable between a fully collapsed lowest position where the lift arms are each laterally adjacent the associated ground-engaging legs, and movable to vertically lifted positions above the lowest position.

13. The jack apparatus of claim 12, including a horizontal beam on the upper subframe, and wherein the arms are laterally adjustable on the horizontal beam.

14. The jack apparatus of claim 13, wherein the horizontal beam includes slots and slot-engaging fasteners for fixing the arms in a selected laterally adjusted position where the arms clear the legs when the upper subframe is in the fully-collapsed lowest position.

15. The jack apparatus of claim 12, wherein the legs each include a telescopingly extendable foot.

16. The jack apparatus of claim 12, wherein at least one or both of the legs and arms includes a telescopingly extendable member.

17. The jack apparatus of claim 12, wherein the table top flat surface is configured to support an ATV vehicle.

18. The jack apparatus of claim 12, wherein the upper and lower subframes define a maximum total height dimension of less than 6 inches when in the fully-collapsed lowest position.

* * * * *